United States Patent [19]

Jokic

[11] Patent Number: 5,055,084

[45] Date of Patent: Oct. 8, 1991

[54] CARD BOX WITH SPRING SURPRISE FLAP

[76] Inventor: Zoran Jokic, 541 Cumberland Ave., Teaneck, N.J. 07666

[21] Appl. No.: 656,454

[22] Filed: Feb. 19, 1991

[51] Int. Cl.[5] ..... A63H 33/00; A63H 33/38; A63J 23/00; G09F 1/08

[52] U.S. Cl. ..... 446/486; 446/488; 446/308; 446/147; 272/27 N; 272/27 R; 40/539

[58] Field of Search ..... 446/486, 487, 488, 489, 446/308, 309, 310, 311, 312, 147, 148, 149, 152; 272/27 R, 27 B, 27 N; 40/539

[56] References Cited

U.S. PATENT DOCUMENTS

| | | | |
|---|---|---|---|
| 508,391 | 11/1893 | Reiff | 272/27 R |
| 691,703 | 1/1902 | Huckstepp | 272/27 B |
| 1,455,653 | 5/1923 | Palmer | 446/310 |
| 1,782,555 | 11/1930 | Weinstein | 446/149 X |
| 1,870,395 | 8/1932 | Zarin | 40/539 |
| 2,349,984 | 5/1944 | Ostrander | 446/310 |
| 2,404,089 | 7/1946 | Pollock | 40/539 |
| 2,472,191 | 6/1949 | Carroll | 446/148 X |
| 2,556,098 | 6/1951 | Muller | 272/27 R |
| 3,228,139 | 1/1966 | Lohnes | 272/27 N |
| 4,774,780 | 10/1988 | Crowell | 446/147 X |

FOREIGN PATENT DOCUMENTS

| | | | |
|---|---|---|---|
| 10842 | 5/1912 | United Kingdom | 446/149 |
| 324164 | 1/1930 | United Kingdom | 446/149 |
| 373169 | 5/1936 | United Kingdom | 40/539 |

*Primary Examiner*—D. Neal Muir

*Attorney, Agent, or Firm*—Charles E. Baxley

[57] ABSTRACT

A spring box is an assembly of a box body and a spring, the box body being formed of a single piece of foldable material such as card stock. The box body bears a message on a message panel. When the box body is closed the message is covered by a cover panel. The boxbody includes a tab that releasably holds the box body closed with the cover panel overlapping the message panel with the spring biasing the message panel against the cover panel. When the tab is released, the spring suddenly opens the box body, thus to push the message panel upward. The upward movement of the message panel causes the cover panel suddenly to move away from the message panel, thus to expose the message to view. During the sudden opening of the box body, the message panel and the cover panel pivotally move in opposite arcuate directions.

7 Claims, 2 Drawing Sheets

CARD BOX WITH SPRING SURPRISE FLAP

BACKGROUND AND SUMMARY OF THE INVENTION

This invention relates to a spring box that is in the nature of a novelty item. More particularly, the box is an assembly of a box body and a spring, the box body being formed of a single piece of foldable material such as card stock.

The box body bears a message on a normally hidden surface of a panel. The normally hidden surface, when the body is closed, is covered by a cover surface of another panel. The box body includes a tab that releasably holds the box body closed with the cover surface in overlapping relationship with the normally hidden surface and with the spring biasing the normally hidden surface against the cover surface. When the tab is released, the spring suddenly opens the box body, thus to push the panel bearing the message upward. The upward movement of the panel bearing the message causes the panel having the cover surface suddenly to move away from the panel bearing the message, thus to expose the message to view. During the sudden opening of the box body, the panel bearing the message and the panel having the cover surface pivotally move in opposite arcuate directions.

The invention provides a spring box that is of simple inexpensive construction and that will give much amusement and pleasure to its users.

Accordingly, important objects of the invention are to provide a spring box that is of simple inexpensive construction and that will give much amusement and pleasure to its users.

The foregoing objects and advantages will appear clearly hereinafter.

DESCRIPTION OF THE INVENTION

Figure 1:
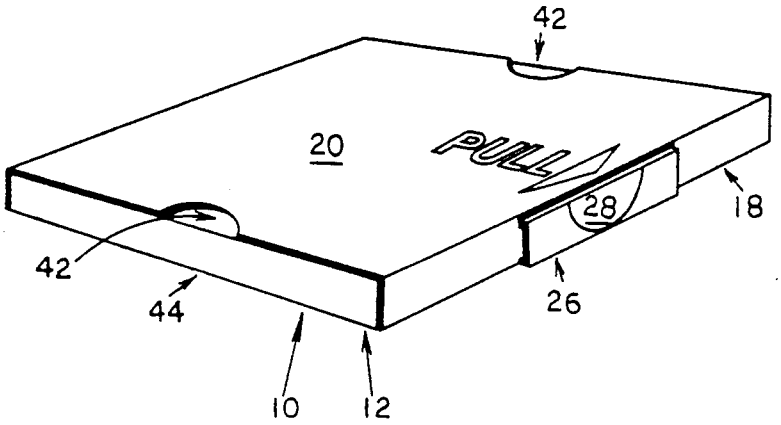
FIG. 1 is a perspective view of a spring box embodying the invention in its closed position.
Figure 2:
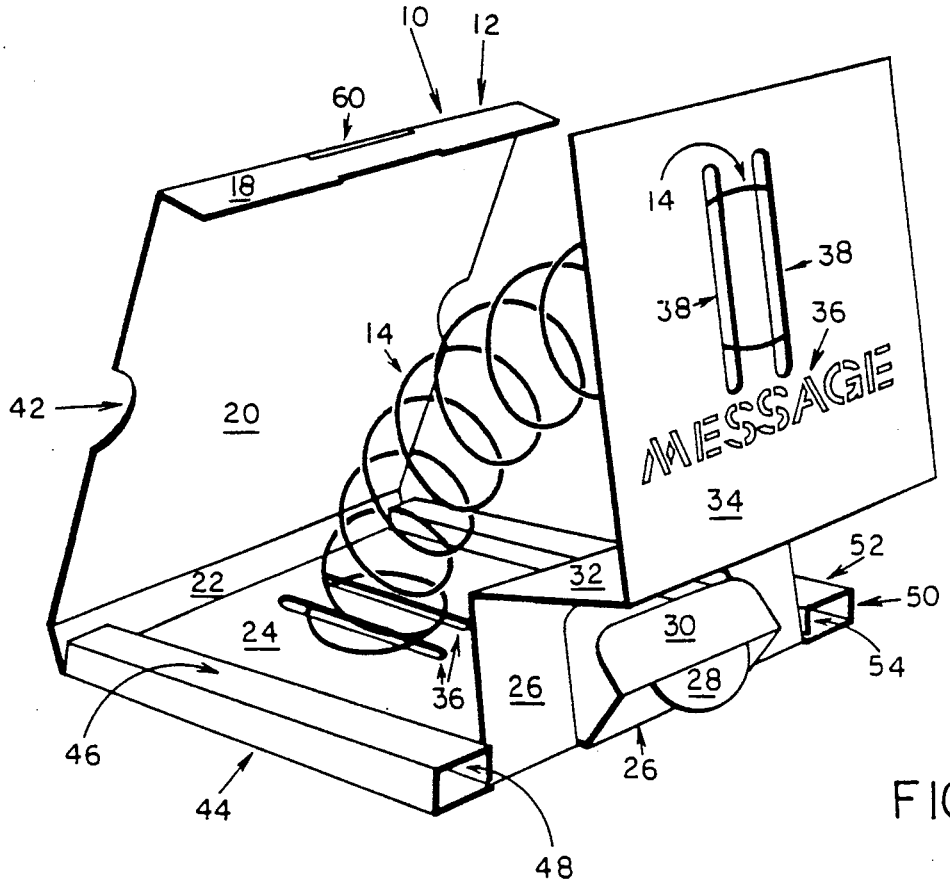
FIG. 2 is a perspective view of the box of FIG. 1 in its open position.

FIGS. 1 and 2 show a spring box 10 that includes a one-piece box body 12 of suitable material such as card stock and a coil spring 14.

Figure 3:
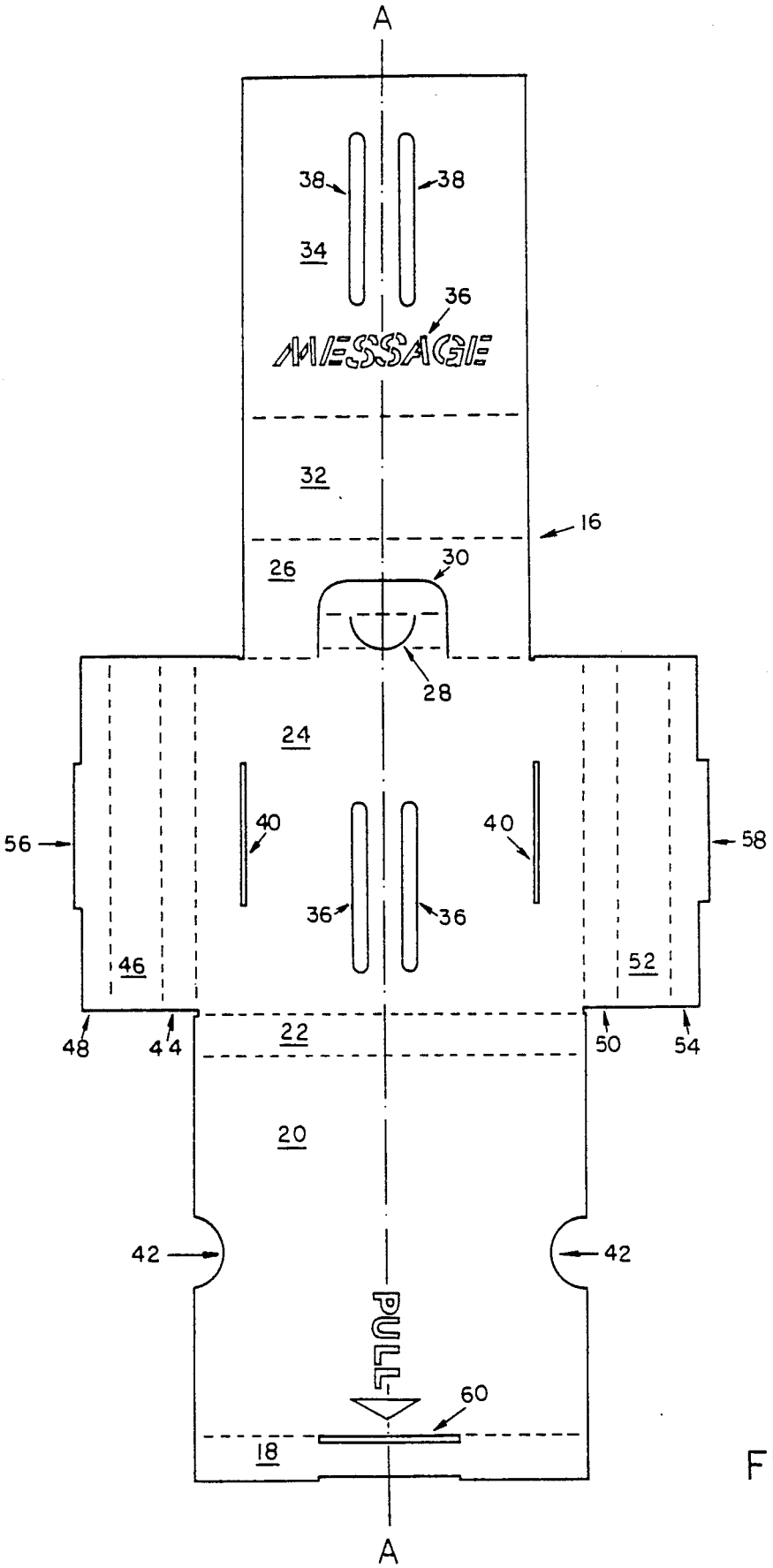
FIG. 3 is a plan view of a flat blank that is convertible into the body of the box of FIGS. 1 and 2.

An understanding of the construction of box 10 will be facilitated by reference to FIG. 3 which shows a flat box body blank 16 that is foldable along various fold lines to become box body 12.

Blank 16 will be described primarily with respect to its panels and fold lines, it first being noted that blank 16 is completely symmetrical relative to a longitudinal center line A—A. As one proceeds from top to bottom along line A—A, one comes to an end panel 18, a substantially square panel 20 bearing the legend "PULL," a connecting panel 22, a panel 24 destined to become the bottom of box body 12, a panel 26 with a semicircular handle 28 and a tab 30 cut therein, a panel 32 of substantially the same size as panel 26 and an end panel 34 bearing a message 36.

Panels 18, 20 and 24 are of the same width, while panels 26, 32 and 34 are of the same width but somewhat narrower than panels 18, 20 and 24.

Panel 24 has a pair of wide slots 36 parallel and relatively close to center line A—A. Likewise, panel 34 has a pair of wide slots 38 parallel and relatively close to center line A—A. Slots 38 are spaced the same distance from line A—A as are slots 36.

Panel 24 also has a pair of narrow slots 40 parallel to center line A—A and equispaced and further therefrom than are slots 36. Slots 40 are substantially aligned with the edges of panels 26, 32 and 34.

Panel 20 also has semicircular cutouts 42 at opposite edges.

Additional narrow panels 44, 46 and 48 project sideways from a side edge of panel 24 and panels 50, 52 and 54 project sideways from the other side edge of panel 24. The free edge of panel 48 has a rectangular projection 56 and the free edge of panel 54 has a projection 58.

A slot 60 extends along the fold line between panels 18 and 20 and is bisected by center line A.

The manner in which blank 16 is converted to box body 12 is believed largely self-evident from FIGS. 1 and 2, by reference to the various appropriate reference numerals. From FIG. 2 it appears that panel 24 has become the bottom of box body 12 and from FIG. 1 that panel 20 has become the top or cover of box body 12.

With further reference to FIG. 2 it appears that one end of coil spring 14 engages slots 36 in panel 24 and that the other end of coil spring 14 engages slots 38 in panel 34.

When box body 12 is closed, tab 30 that is integral with panel 26 engages slot 60 that is on the fold line between panels 18 and 20. In this condition, spring 14 is compressed between panels 24 and 34 and the message on panel 34 is covered by panel 20. See FIG. 1.

When it is desired to view the message, the viewer merely pulls on handle 28, removing tab 30 from slot 60, immediately allowing spring 14 to expand, pushing panel 34 away from bottom panel 24 and causing panel 34 to push cover panel 20 upwardly away from bottom panel 24, thus to expose the message to view.

During the springing action that takes place when tab 30 leaves slot 60, message panel 34 pivots in one direction (toward the viewer) while cover panel 20 pivots in the opposite direction (away from the viewer).

Box 10 can be returned to the closed position of FIG. 1 from the open position of FIG. 2.

It is apparent that the invention attains the stated objects and advantages among others.

The disclosed details are exemplary only and are not to be taken as limitations on the invention except as those details may be included in the appended claims.

What is claimed is:

1. A spring box comprising a box body having a plurality of panels joined by parallel fold lines, said panels including a bottom panel, a message panel bearing a message and a cover panel that covers said message panel when said box body is closed with said cover panel overlapping said message panel and hiding said message, and a spring having a first end engaging said bottom panel and a second end engaging said message panel and compressed therebetween when said box body is closed, said box body further having a tab for releasably holding said box body closed, and so that when said tab is released, said spring suddenly opens said box body pushing said message panel away from said bottom panel, in turn causing said cover panel to move away from said message panel thus to expose said message to view, and wherein said message panel is joined indirectly to said bottom panel by first and second additional panels and said cover panel is joined indirectly to said bottom panel by a third additional panel, said first additional panel being joined to said message panel along a first fold line and to said second panel along a second fold line and said second panel being joined to said bottom panel along a third fold line, said cover panel being joined to said third additional panel along a fourth fold line and said third additional panel being joined to said bottom panel along a fifth fold line, and said tab being a portion of said second additional panel.

2. A box according to claim 1 wherein said message panel and said cover panel are joined to said bottom panel on opposite sides thereof, whereby during opening of said box body, said message panel and said cover panel move in opposite arcuate directions.

3. A box according to claim 1 wherein said first, second, third, fourth and fifth fold lines are parallel to each other and said third and fifth fold lines delineate opposite edges of said bottom panel.

4. A box according to claim 3 wherein when said box is closed, said message panel and said cover panel are substantially parallel to said bottom panel with said message panel between said bottom panel and said cover panel and with said first and second additional panels between said message panel and said bottom panel.

5. A box according to claim 4 wherein said panels further include an end panel joined to said cover panel along a sixth fold line parallel to said first, second, third, fourth and fifth fold lines, said sixth fold line being provided with a slot of limited length therealong for releasably receiving said tab when said box body is closed to hold said box body closed.

6. A box according to claim 1 wherein said box body is of one-piece construction.

7. A box according to claim 6 wherein said box body is fabricated of card stock.

* * * * *